US005513715A

United States Patent [19]

Dysart

[11] Patent Number: 5,513,715

[45] Date of Patent: May 7, 1996

[54] FLAT SEAL FOR A ROLLER CONE ROCK BIT

[75] Inventor: Theodore R. Dysart, Arlington, Tex.

[73] Assignee: Dresser Industries, Inc., Dallas, Tex.

[21] Appl. No.: 299,821

[22] Filed: Aug. 31, 1994

[51] Int. Cl.[6] ..... E21B 10/22

[52] U.S. Cl. ..... 175/371; 277/92; 277/235 R; 384/94

[58] Field of Search ..... 175/371, 372; 277/92, 235 R, 235 A; 384/94

[56] References Cited

U.S. PATENT DOCUMENTS

| | | | |
|---|---|---|---|
| 3,096,835 | 7/1963 | Neilson . | |
| 3,125,175 | 3/1964 | Medlock et al. . | |
| 3,171,662 | 3/1965 | Warn et al. | 277/235 X |
| 3,370,895 | 2/1968 | Cason, Jr. | 384/94 |
| 3,467,448 | 9/1969 | Galle . | |
| 3,480,341 | 11/1969 | Hickernell | 175/372 X |
| 3,489,421 | 1/1970 | Neilson | 277/235 R |
| 3,529,840 | 9/1970 | Durham et al. | 277/92 |
| 3,604,523 | 6/1970 | Lichte | 175/372 |
| 3,656,764 | 4/1972 | Robinson | 277/92 |
| 3,739,864 | 6/1973 | Cason, Jr. et al. | 175/228 |
| 3,921,735 | 11/1975 | Dysart | 175/337 |
| 3,952,815 | 4/1976 | Dysart | 175/374 |
| 4,056,153 | 11/1977 | Miglierini | 175/376 |
| 4,073,548 | 2/1978 | Walters | 175/228 X |
| 4,087,100 | 5/1978 | Yoshihashi et al. | 277/92 |
| 4,092,054 | 5/1978 | Dye | 175/337 |
| 4,098,358 | 7/1978 | Klima | 175/65 |
| 4,102,419 | 7/1978 | Klima | 175/371 |
| 4,158,394 | 6/1979 | Ernst et al. | 175/228 |
| 4,176,848 | 12/1979 | Lafuze | 277/92 |
| 4,179,003 | 12/1979 | Cooper et al. | 175/371 |
| 4,183,416 | 1/1980 | Walters | 175/228 X |
| 4,183,417 | 1/1980 | Levefelt | 175/339 |
| 4,199,856 | 4/1980 | Farrow et al. | 29/454 |
| 4,225,144 | 9/1980 | Zitz et al. | 277/12 |
| 4,249,622 | 2/1981 | Dysart | 175/227 |
| 4,253,710 | 3/1981 | Goodman | 175/372 |
| 4,256,193 | 3/1981 | Kunkel et al. | 175/371 |
| 4,258,806 | 3/1981 | Kunkel et al. | 175/370 |
| 4,272,134 | 6/1981 | Levefelt | 175/337 |
| 4,279,450 | 7/1981 | Morris | 175/372 X |
| 4,284,310 | 8/1981 | Olschewski et al. | 175/372 X |
| 4,287,957 | 9/1981 | Evans | 175/17 |
| 4,298,079 | 11/1981 | Norlander et al. | 175/339 |
| 4,375,242 | 3/1983 | Galle | 175/228 |
| 4,386,668 | 6/1983 | Parish | 175/228 |
| 4,388,984 | 6/1983 | Oelke | 184/54 |
| 4,421,184 | 12/1983 | Mullins | 175/337 |
| 4,453,836 | 6/1984 | Klima | 384/94 |
| 4,515,228 | 5/1985 | Dolezal et al. | 175/313 |
| 4,533,003 | 8/1985 | Bailey et al. | 175/269 |
| 4,552,233 | 11/1985 | Klima | 175/371 |
| 4,593,775 | 6/1986 | Chaney et al. | 175/228 |
| 4,597,455 | 7/1986 | Walters et al. | 175/228 |
| 4,610,319 | 9/1986 | Kalai | 175/371 |
| 4,610,452 | 9/1986 | DiRienz | 277/83 |
| 4,629,338 | 12/1986 | Ippolito | 384/94 |
| 4,688,651 | 8/1987 | Dysart | 175/371 |

(List continued on next page.)

FOREIGN PATENT DOCUMENTS 201992 3/1979 United Kingdom .

*Primary Examiner*—Hoang C. Dang
*Attorney, Agent, or Firm*—Baker & Botts

[57] ABSTRACT

A flat seal (32) for a roller cone rock bit (10) is provided. Flat seal (32) includes a ring-shaped metallic spring (80). Metallic spring (80) has an inner face (88) with an annular inner edge (92) for contacting a sealing surface (72) of a cone (18) in a roller cone rock bit (10). Metallic spring (80) also has outer face (86) with an annular outer edge (90) for contacting a sealing surface (70) of a spindle (16) in the roller cone rock bit (10). Metallic spring (80) has a relaxed axial pitch greater than a clearance (76) between sealing surfaces (70) and (72) of cone (18) and spindle (16). Flat seal (32) also includes an annular inner elastomer shroud (84) disposed on inner face (88) of metallic spring (80) such that the annular inner edge (92) is exposed. Flat seal (32) further includes an annular outer elastomer shroud (82) disposed on outer face (86) of metallic spring (80) such that the annular outer edge (90) is exposed.

9 Claims, 2 Drawing Sheets

U.S. PATENT DOCUMENTS

| | | | |
|---|---|---|---|
| 4,722,404 | 2/1988 | Evans | 277/335 R |
| 4,813,502 | 3/1989 | Dysart | 175/337 |
| 4,822,057 | 4/1989 | Chia et al. | 277/92 X |
| 4,865,136 | 9/1989 | White | 175/227 |
| 4,942,930 | 7/1990 | Millsapps | 175/228 |
| 4,981,182 | 1/1991 | Dysart | 175/71 |
| 5,027,911 | 7/1991 | Dysart | 175/57 |
| 5,080,183 | 1/1992 | Schumacher et al. | 175/371 |
| 5,131,480 | 7/1992 | Lockstedt et al. | 175/374 |
| 5,145,016 | 9/1992 | Estes | 175/331 |

FLAT SEAL FOR A ROLLER CONE ROCK BIT

This application is related to U.S. patent application Ser. No. 08/2899,484, filed Aug. 31, 1994, entitled *Sealed and Lubricated Rotary Cone Drill Bit Having Improved Seal Protection*; U.S. patent application Ser. No. 08/299,485, filed Aug. 31, 1994, entitled *Compression Seal for a Roller Cone Rock Bit*; and U.S. patent application Ser. No. 08/299,492, filed Aug. 31, 1994 entitled *Roller cone Rock Bit Having a Sealing System with Double Elastomer Seals* now U.S. Pat. No. 5,441,120.

TECHNICAL FIELD OF THE INVENTION

This invention relates in general to the field of roller cone rock bits used in drilling a borehole in the earth, and more particularly to an improved flat seal for a roller cone rock bit.

BACKGROUND OF THE INVENTION

One type of drill bit used in forming a borehole in the earth is a roller cone rock bit. A typical roller cone rock bit comprises a body with an upper end adapted for connection to a drill string. A plurality of arms, typically three, depend from the lower end portion of the body. Each arm includes a spindle protruding radially inward and downward with respect to a projected rotationally axis of the body. Each cutter cone also defines an internal cavity shaped to receive an associated spindle. A cutter cone may be mounted on each spindle and rotatably supported on bearings acting between the spindle and the inside of the cavity in the cutter cone. One or more nozzles often are located on the underside of the body and radially inward of the arms. These nozzles are generally positioned to direct drilling fluid passing downwardly from the drill string to the bottom of the borehole being formed. The drilling fluid washes away the material removed from the bottom of the borehole and cleanses the cutter cones carrying the cuttings radially outward then upward within the annulus defined between the bit body and the wall of the borehole.

Protection of the bearings that allow rotation of the cutter cone can lengthen the useful service life of a roller cone rock bit. Once drilling debris or external fluids are allowed to infiltrate between the bearing surfaces of the cutter cone and the spindle, failure of the roller rock bit will follow shortly. Various mechanisms are employed to keep debris and external fluids from entering between the bearing surfaces. A typical approach is to utilize an elastomer seal across the gap between the bearing surfaces of the rotating cutter cone and its support on the spindle. However, when this seal fails, it is not long before external fluids or drilling debris contaminate the bearing surfaces through the gap between the cutter cone and the spindle. Thus, it is important that the seal be fully protected against wear caused by debris in the borehole and protected from pressure exerted by external fluids, such as water present in the borehole.

In a sealed roller cone rock bit, the cavity in the cutter cone and the bearings are lubricated by packing the cavity and bearings with a lubricant such as grease. This lubricant is sealed from the external environment by the elastomer seal across the gap between the cutter cone and the spindle. It is important that the lubricant not be contaminated with external fluids or debris. This seal is especially important when the roller cone rock bit is used in drilling a deep well, such as a deep oil or gas well, where the borehole is filled with a column of water or other liquids exerting tremendous pressure on the seal. In such a high pressure downhole environment, the external fluids exert constant pressure on the outer side of the seal. If the seal fails, external fluids can mix with the lubricant and quickly cause failure of the roller cone rock bit. Thus, it is important to maintain the integrity of the seal.

A safeguard used in some roller cone rock bits is a second seal outward from the first elastomer seal. The addition of a second seal creates a seal gap between the second seal and the first seal. The second seal acts as an initial barrier to the external fluids and debris. Examples of a roller cone rock bit having a second outward seal are described in U.S. Pat. No. 4,981,182 and U.S. Pat. No. 5,027,911. Both of these patents show an outer seal utilizing a Belleville spring washer molded with a rubber or elastomer shroud. Such flat face seals are often used in roller cone rock bits.

At assembly of the roller cone rock bit and arm parts, the Belleville spring is compressed and thereby imparts a force upon the elastomer shroud which effects the sealing function. This flat seal is presently in widespread use in roller cone rock bits. Originally, such seals were the principal sealing methods used in roller cone rock bits. They have been replaced in recent years by ring-type shaft seals, such as O-rings and similar elastomer ring seals. Recently, however, the flat seal has been used as the outer protective member of a double seal group in conjunction with an inner seal. Use of a flat seal as an outer barrier is shown in the above patents.

In current usage, the elastomer shroud of the flat seal must stay intact for there to be an effective sealing function and for the flat seal to protect the inner seal. When the elastomer shroud is worn or abraded due to debris in the borehole, then the Belleville spring washer can no longer exclude borehole debris from reaching and acting upon the main inner seal because the Belleville spring by itself does not form a seal. The elastomer eventually is worn to the extent that a seal is no longer affected and debris is allowed to attack the integrity of the inner seal.

SUMMARY OF THE INVENTION

Therefore, a need has arisen for a flat seal for a roller cone rock bit that enjoys a longer lifetime, thus producing a longer roller cone rock bit life.

In accordance with the present invention, an improved flat seal for a roller cone rock bit is provided that provides a longer lifetime barrier against borehole debris substantially eliminating or reducing disadvantages and problems associated with prior flat seals.

According to one embodiment of the present invention, an improved flat seal for a roller cone rock bit is provided. The flat seal preferably includes a ring-shaped metallic spring. The metallic spring has an inner face with an annular inner edge for contacting a sealing surface of a spindle in a roller cone rock bit. The ring-shaped metallic spring also has an outer face with an annular outer edge for contacting a sealing surface of a cone in the roller cone rock bit. The metallic spring has a relaxed axial pitch greater than a clearance between the sealing surfaces of the cone and the spindle. The flat seal also includes an annular inner elastomer shroud disposed on the inner face of the metallic spring. The flat seal further includes an annular outer elastomer shroud disposed on the outer face of the metallic spring.

A technical advantage of the present invention is that the metallic spring substantially fills the seal gland between the spindle and the cone, thus remaining as a fluid barrier even after the elastomer shroud is worn or abraded.

A further technical advantage of the present invention is that the metal-to-metal seal surfaces of a flat seal constructed according to the teachings of the present invention provides a longer lifetime than elastomer-to-metal seal surfaces. The inner edge and outer edge of the metallic spring are exposed to make metal-to-metal contact with the adjacent sealing surfaces of the cone and the spindle.

A further technical advantage of the present invention is that the outer elastomer shroud serves as an anchor for the seal on the spindle so that the sealing surface of the cone is the only dynamic interface.

Another technical advantage of the present invention is that the seal gland can be narrower because a flat seal constructed according to the teachings of the present invention is thinner than conventional flat seals. A narrower seal gland provides additional protection for an inner seal when the outer seal is no longer viable.

BRIEF DESCRIPTION OF THE DRAWINGS

A more complete understanding of the present invention may be acquired by referring to the following description taken in conjunction with the accompanying drawings in which like reference numbers indicate like features and wherein.

DETAILED DESCRIPTION OF THE INVENTION

Figure 1:
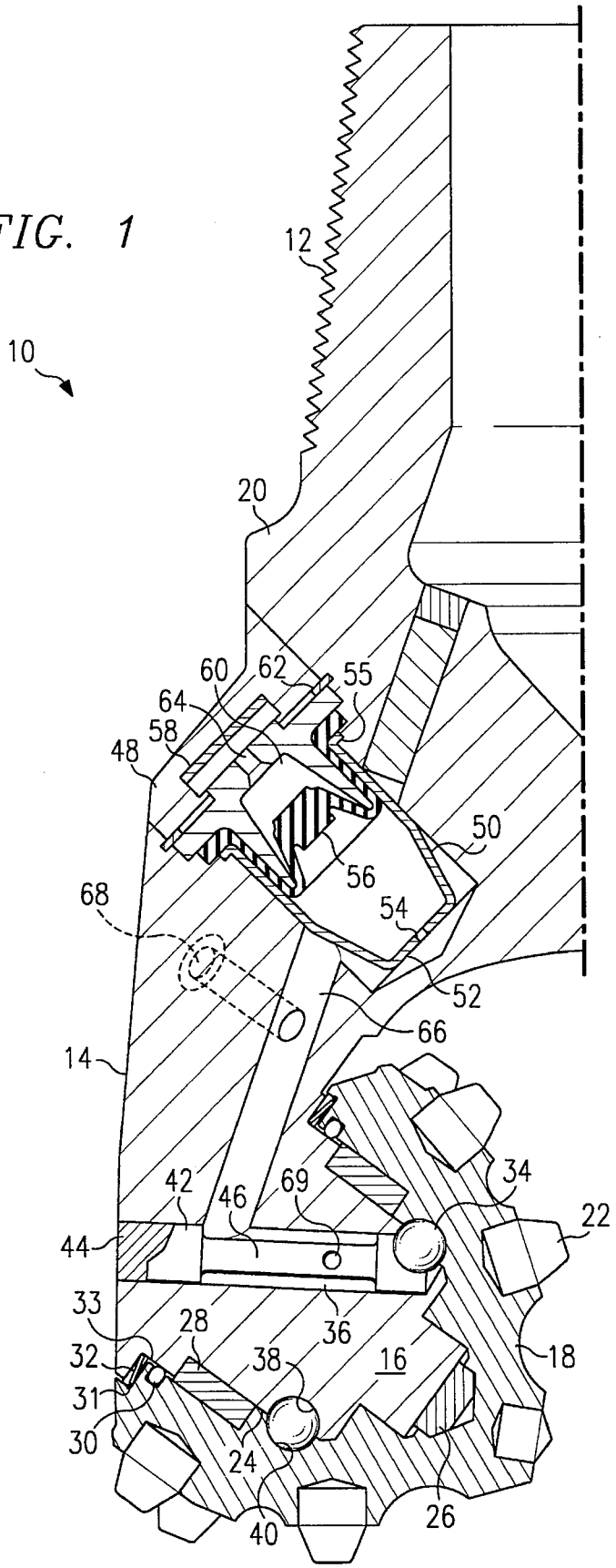
FIG. 1 illustrates a cross-sectional view with portions broken away of a roller cone rock bit including one embodiment of a flat seal constructed according to the teachings of the present invention.
Figure 2:
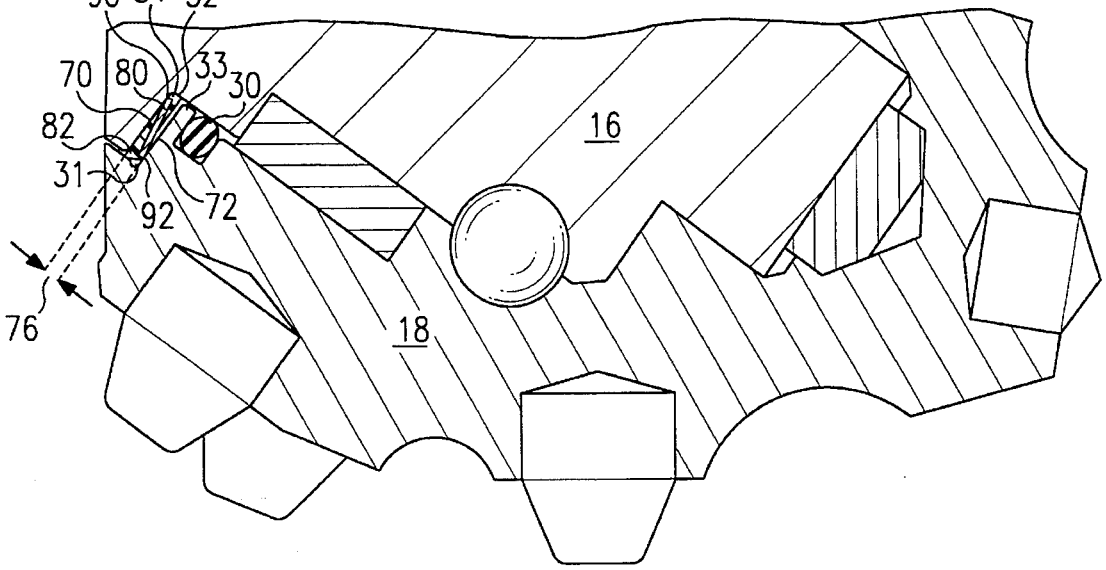
FIG. 2 illustrates an enlarged cross-sectional view of the inner elastomer seal and outer elastomer seal illustrated in FIG. 1.
Figure 3:
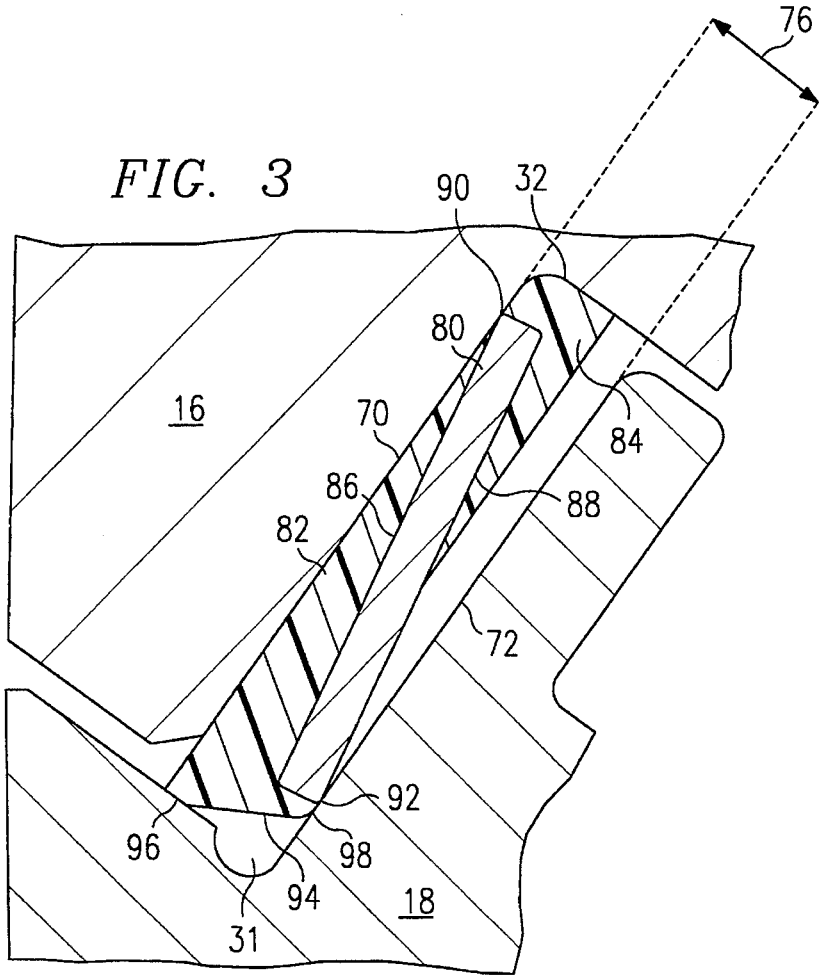
FIG. 3 illustrates an enlarged cross-sectional view of a flat seal for a roller cone rock bit constructed according to the teachings of the present invention in a compressed state.

The preferred embodiments of the present invention and its advantages are best understood by referring to FIGS. 1 through 3 of the drawings, like numerals being used for like and corresponding part of the drawings.

FIG. 1 illustrates a cross-sectional view of a portion of a roller cone rock bit, indicated generally at 10, including one embodiment of a flat seal constructed according to the teachings of the present invention. In a completed roller cone rock bit, there are generally three arms but only one is illustrated in FIG. 1.

Roller cone rock bit 10 includes a bit body having an upper threaded portion 12 for connecting roller cone rock bit 10 to the lower end of a rotary drill string. On the end opposite threaded portion 12 is a depending arm 14 terminating in an inwardly downwardly directed spindle 16 on which a cutter cone 18 is rotatably mounted. The portion of roller cone rock bit 10 intermediate threaded portion 12 and spindle 16 provides a thickened dome portion 20.

Cutter cone 18 is a generally conically-shaped structure having tungsten carbide or other cutting structures 22 projecting outwardly from its surface. Cutter cone 18 has an internal cavity 24 shaped to be rotatably supported on spindle 16. As is shown, internal cavity 24 includes a thrust button 26 for thrust bearing engagement with spindle 16 and includes a plurality of roller bearings 28 set into internal cavity 24 for rotational bearing engagement with spindle 16.

An elastomer seal 30 is located at the mouth of internal cavity 24 to provide a seal between internal cavity 24 and spindle 16. This provides a seal-bearing assembly for cutter cone 18 mounted on spindle 16. Spindle 16 and cutter cone 18 form a seal gland 31 outward from elastomer seal 30. A flat seal 32, constructed according to the teachings of the present invention, is located in seal gland 31 outwardly from elastomer seal 30 as shown. Flat seal 32 provides an additional fluid barrier between cutter cone 18 and spindle 16. A seal gap 33 is formed between elastomer seal 30 and flat seal 32. In one embodiment of the present invention, elastomer seal 30 is an O-ring or a similar elastomer ring seal forming a fluid-tight seal.

Cutter cone 18 is retained on spindle 16 by a plurality of ball bearings 34 inserted through a ball passage 36 in spindle 16. Ball bearings 34 reside in an annular array within cooperatively associated ball races 38 and 40 in spindle 16 and cutter cone 18, respectively. Once inserted, ball bearings 34 prevent the disengagement of cutter cone 18 from spindle 16. Ball passage 36 subsequently is plugged with a ball plug 42 welded at 44 into ball passage 36. Ball plug 42 provides a necked down intermediate portion 46.

A lubricant cavity 48 open to the outside surface of roller cone rock bit 10 is provided in dome portion 20. Lubricant cavity 48 houses a main lubricant reservoir. The main lubricant reservoir comprises a generally cylindrical lubricant container 50 disposed within lubricant cavity 48. Lubricant container 50 has a closed end 52 having a lubricant opening 54. The opposite open end of lubricant container 50 has a flanged shoulder 55 supporting a flexible resilient diaphragm 56 that closes lubricant container 50. A cap 58 covers diaphragm 56 and defines a chamber 60 facing diaphragm 56 to provide a volume into which diaphragm 56 can expand. Cap 58, diaphragm 56 and lubricant container 50 are retained within lubricant cavity 48 by a snap ring 62. Cap 58 also includes an opening 64 for placing the outer face of diaphragm 56 in fluid communication with external fluids surrounding roller cone rock bit 10. The volume between diaphragm 56 and lubricant container 50 may be filled with a suitable lubricant to define a source of lubricant for roller bearings 28 and ball bearings 24 of roller cone rock bit 10.

A lubricant passage 66 is drilled through arm 14 to place lubricant cavity 48 in fluid communication with ball passage 36. Lubricant passage 66 is drilled from an end of lubricant cavity 48 generally adjacent lubricant opening 54 and lubricant container 50. Ball passage 36 is placed in fluid communication with internal cavity 24 by conduit 69. Upon assembly of roller cone rock bit 10, lubricant passage 66, lubricant container 50, lubricant cavity 48, the available space in the ball plug passage 36, conduit 69 and the available space in internal cavity 24 are filled with lubricant through an opening 68 in arm 14. Opening 68 is subsequently sealed after lubricant filling.

The pressure of the external fluids outside roller cone rock bit 10 may be transmitted to the lubricant in lubricant container 50 through diaphragm 56. The flexing of diaphragm 56 maintains the lubricant at a pressure generally equal to the pressure of the external fluids outside roller cone rock bit 10. This pressure is transmitted through lubricant passage 66, ball passage 36, conduit 69 and internal cavity 24 to the inward face of elastomer seal 30 exposing elastomer seal 30 to an internal pressure from the lubricant generally equal to the pressure of the external fluids.

Flat seal 32 operates as a barrier to external fluids and debris to protect the integrity of elastomer seal 30. According to the teachings of the present invention, flat seal 32 comprises a ring-shaped metallic spring and an elastomer shroud disposed on each face of the metallic spring. This structure of flat seal 32 is illustrated in and discussed in more detail with respect to FIG. 2 and FIG. 3. In one embodiment of the present invention, flat seal 32 substantially fills seal gland 31.

FIG. 2 illustrates an enlarged cross-sectional view of elastomer seal 30 and flat seal 32 illustrated in FIG. 1. As shown in FIG. 2, spindle 16 includes a sealing surface 70, and cutter cone 18 includes a sealing surface 72. Sealing surface 70 and sealing surface 72 form seal gland 31 for flat seal 32. Seal gland 31 has a clearance 76 between sealing surface 70 and sealing surface 72. Clearance 76 of seal gland 31 is narrower than the clearance of seal glands for conventional flat seals. This is due to the fact that flat seal 32 is thinner because it is not completely encased by elastomer shrouding.

Flat seal 32 comprises a ring-shaped metallic spring 80. In one embodiment of the present invention, metallic spring 80 is a metal Belleville spring. Flat seal 32 also comprises an outer elastomer shroud 82 and an inner elastomer shroud 84. As shown in more detail in FIG. 3, metallic spring 80 has two annular edges that are exposed such that the annular edges directly contact respective sealing surface 70 and sealing surface 72.

FIG. 3 illustrates an enlarged cross-sectional view of flat seal 32 of roller cone rock bit 10 constructed according to the teachings of the present invention. FIG. 3 illustrates flat seal 32 in a compressed state in assembled roller cone rock bit 10.

Metallic spring 80 includes an outer face 86 and an inner face 88. As shown, outer elastomer shroud 82 is disposed on outer face 86, and inner elastomer shroud 84 is disposed on inner face 88. In its free state, metallic spring 80 has a relaxed pitch greater than clearance 76 between sealing surface 70 of spindle 16 and sealing surface 72 of cone 18. Outer face 86 of metallic spring 80 has an annular outer edge. 90 for contacting sealing surface 70 of spindle 16. Similarly, inner face 88 of metallic spring 80 has an annular inner edge 92 for contacting sealing surface 72 of cone 18. In the illustrated embodiment, outer shroud 82 has a bevelled surface 94 that includes an outer edge 96 and an inner edge 98. Outer edge 96 and inner edge 98 are formed to provide point contact with sealing surface 72 of cone 18.

As illustrated, outer elastomer shroud 82 contacts both spindle 16 and cone 18 when flat seal 32 is in a compressed state. In this state, annular outer edge 90 contacts spindle 16 and annular inner edge 92 contacts cone 18 as shown. Inner elastomer shroud 84, unlike outer elastomer shroud 82, contacts only spindle 16. Outer elastomer shroud 82 contacts sealing surface 70 preventing flat seal 32 from rotating with cone 18 such that sealing surface 72 of cone 18 slides past and is in sealing contact with annular inner edge 92 of metallic spring 80.

A flat seal constructed according to the teachings of the present invention utilizes a metallic spring having exposed ends such that the metallic spring makes contact at both ends. One embodiment of the present invention utilizes a Belleville spring washer partially covered with elastomer shrouding. Contact of the metallic spring with the metal sealing surfaces of the seal gland effects metal-to-metal sealing couples at both points of contact. These couples are more rugged and more long-lasting than the elastomer-to-metal contacts of conventional flat seals. The elastomer shrouding serves to protect the metallic spring from abrasive borehole debris. A flat seal constructed according to the teachings of the present invention does not require the elastomer shrouding to function as a barrier to external fluids and debris. It will maintain its barrier function even after the elastomer is abraded by borehole debris.

A technical advantage of the present invention is that the metallic spring substantially fills the seal gland between the spindle and the cone, thus remaining as a sealing barrier even after all of the elastomer shrouding is worn or abraded.

A further technical advantage of the present invention is that the metal-to-metal seal surfaces of a flat seal constructed according to the teachings of the present invention provides a longer lifetime than elastomer-to-metal seal surfaces. The inner edge and outer edge of the metallic spring are exposed and to make metal-to-metal contact with the sealing surfaces of the cone and the spindle.

A further technical advantage of the present invention is that the outer elastomer shroud serves as an anchor for the seal on the spindle so that the sealing surface of the cone is the only dynamic interface.

Another technical advantage of the present invention is that the seal gland can be narrower because of a flat seal constructed according to the teachings of the present invention is thinner than conventional flat seals. A narrower seal gland provides additional protection for an inner seal when the outer seal is no longer viable.

Although the present invention has been described in detail, it should be understood that various changes, substitutions and alterations can be made hereto without departing from the spirit and scope of the invention as defined by the appended claims.

What is claimed:

1. A roller cone rock bit, comprising:

a bit body having at least one downwardly extending arm terminating in a spindle having an inwardly downwardly directed axis, the spindle also having a sealing surface;

a cutter cone rotatably mounted on the spindle, the cone having a cavity for receipt of the spindle and having a sealing surface, wherein the sealing surface of the cone and the sealing surface of the spindle define a seal gland;

a bearing assembly disposed within the cavity, the beating assembly in rotary load bearing engagement between the spindle and the cone and the cavity filled with a lubricant;

a first seal to maintain the lubricant in the cavity and a barrier to exclude borehole debris and to protect the first seal;

the first seal blocking the lubricant from the barrier;

an elastomer seal located adjacent to the bearing assembly to provide the first seal between the spindle and the cavity;

the barrier formed by a flat seal disposed in the seal gland, comprising:

a ring-shaped metallic spring, the metallic spring having an inner face with an annular inner edge for contacting the sealing surface of the cone and having an outer face with an annular outer edge for contacting the sealing surface of the spindle, wherein the metallic spring has a relaxed axial pitch greater than a clearance of the seal gland;

an annular inner elastomer shroud disposed on the inner face of the metallic spring such that the annular inner edge is exposed; and an annular outer elastomer shroud disposed on the outer face of the metallic spring such that the annular outer edge is exposed; and the contact between the annular inner edge of the metallic spring and the sealing surface of the cone in cooperation with the contact between the annular outer edge of the metallic spring and the sealing surface of the spindle, providing the barrier to exclude borehole debris and protect the first seal: and the metallic spring is sized to substantially fill the seal gland defined by the sealing surface of the spindle and the sealing surface of the cone to provide the barrier to exclude borehole debris even after the annular inner elastomer shroud and the annular outer elastomer shroud have been abraded.

2. The roller cone rock bit of claim 1, wherein the metallic spring comprises a metallic Belleville spring and the annular outer elastomer shroud preventing rotation of the metallic Belleville spring with the cone.

3. The roller cone rock bit claim 2, wherein the metallic Belleville spring is constructed from stainless steel.

4. The roller cone rock bit of claim 1, wherein the outer elastomer shroud is operable to contact the sealing surface of the spindle preventing the fiat seal from rotating with the cone such that the sealing surface of the cone slides past and is in sealing contact with the inner edge of the metallic spring.

5. The roller cone rock bit, of claim 4, wherein the outer elastomer shroud has a beveled surface for providing point contact with the sealing surface of the cone at an inner edge of the beveled surface and at an outer edge of the beveled surface.

6. The roller cone rock bit of claim 5, wherein the sealing surface of the cone includes a first portion and a second portion, the first portion extending radially relative to a rotational axis of the cone such that the first portion contacts the inner edge of the metallic spring, and the second portion extending longitudinally such that the second portion is engaged by tip contact with the outer edge of the beveled surface of the outer elastomer shroud.

7. A method of forming a debris barrier in a roller cone rock bit having at least one and with a spindle projecting from the arm and a cutter cone mounted on the spindle with a beating assembly disposed between the spindle and the cutter cone to allow rotation of the cutter cone, comprising the steps of:

providing an elastomer seal adjacent to the beating assembly to form a fluid seal between the spindle and the cavity;

forming a narrow seal gland between a first sealing surface on the spindle and a second sealing surface on the cutter cone;

forming a ting-shaped metallic spring, the metallic spring having an inner face with an annular inner edge for contacting the second sealing surface on the cutter cone and having an outer face with an annular outer edge for contacting the first sealing surface on the spindle, wherein the metallic spring has a relaxed axial pitch greater than a clearance of a seal gland defined by the sealing surfaces of the cone and the spindle;

placing an annular inner elastomer shroud on the inner face of the metallic spring such that the annular inner edge is exposed;

placing an annular outer elastomer shroud on the outer face of the metallic spring such that the annular outer edge is exposed;

placing the annular outer elastomer shroud such that the annular outer elastomer Shroud is operable to contact the sealing surface of the spindle, preventing the metallic spring from rotating with the outer cone;

forming the annular outer elastomer shroud with a beveled surface to provide a point contact with the sealing surface of the cutter cone at an inner edge and at an outer edge of the beveled surface; and placing the ring-shaped metallic spring in the seal gland to form the debris barrier to exclude borehole debris and protect the elastomer seal.

8. The method of claim 7, wherein the step of forming a ring-shaped metallic spring further comprises sizing the metallic spring to substantially fill the narrow seal gland.

9. The method of claim 8, wherein the step of forming a ring-shaped metallic spring further comprises forming a metallic Belleville spring.

* * * * *